US008123481B1

(12) United States Patent
Liang

(10) Patent No.: US 8,123,481 B1
(45) Date of Patent: Feb. 28, 2012

(54) TURBINE BLADE WITH DUAL SERPENTINE COOLING

(75) Inventor: George Liang, Palm City, FL (US)

(73) Assignee: Florida Turbine Technologies, Inc., Jupiter, FL (US)

( * ) Notice: Subject to any disclaimer, the term of this patent is extended or adjusted under 35 U.S.C. 154(b) by 506 days.

(21) Appl. No.: 12/486,188

(22) Filed: Jun. 17, 2009

(51) Int. Cl.
*F01D 5/08* (2006.01)
*F01D 5/20* (2006.01)

(52) U.S. Cl. ..... 416/97 R

(58) Field of Classification Search ..... 416/97 R, 416/92, 115
See application file for complete search history.

(56) References Cited

U.S. PATENT DOCUMENTS 5,813,836 A * 9/1998 Starkweather ..... 416/97 R
6,164,914 A * 12/2000 Correia et al. ..... 416/97 R
6,220,817 B1 * 4/2001 Durgin et al. ..... 416/97 R
6,832,889 B1 * 12/2004 Lee et al. ..... 415/115
7,296,972 B2 * 11/2007 Liang ..... 416/97 R
7,547,191 B2 * 6/2009 Liang ..... 416/97 R
7,645,122 B1 * 1/2010 Liang ..... 416/97 R
7,988,417 B1 * 8/2011 Liang ..... 416/90 R
8,011,888 B1 * 9/2011 Liang ..... 416/92
8,025,482 B1 * 9/2011 Liang ..... 416/97 R

* cited by examiner

*Primary Examiner* — Edward Look
*Assistant Examiner* — Su Htay
(74) *Attorney, Agent, or Firm* — John Ryznic

(57) ABSTRACT

A turbine rotor blade with a low cooling flow serpentine circuit to provides cooling for the airfoil. The circuit includes a three pass aft flowing serpentine circuit that begins at the airfoil mid-chord region and connects to a series of multiple impingement cooling holes formed within the trailing edge region. A double pass forward flowing serpentine circuit then connects with the triple pass aft flowing serpentine circuit to provide cooling for the airfoil mid-chord region and then discharges the cooling air into a blade tip cooling channel to provide cooling for the blade tip section. The three pass aft flowing serpentine circuit includes a tip turn that provides cooling for a forward section of the blade tip not covered by the tip cooling channel.

10 Claims, 4 Drawing Sheets

View A-A

TURBINE BLADE WITH DUAL SERPENTINE COOLING

GOVERNMENT LICENSE RIGHTS

None.

CROSS-REFERENCE TO RELATED APPLICATIONS

None.

BACKGROUND OF THE INVENTION

1. Field of the Invention

The present invention relates generally to a gas turbine engine, and more specifically to an air cooled blade in a gas turbine engine.

2. Description of the Related Art Including Information Disclosed Under 37 CFR 1.97 and 1.98

A gas turbine engine includes a turbine with multiple rows or stages of rotor blades that react with a high temperature gas flow to drive the engine or, in the case of an industrial gas turbine (IGT), drive an electric generator and produce electric power. It is well known that the efficiency of the engine can be increased by passing a higher temperature gas flow into the turbine. However, the turbine inlet temperature is limited to the material properties of the first stage vanes and blades and the amount of cooling that can be achieved for these airfoils.

In latter stages of the turbine, the gas flow temperature is lower and thus the airfoils do not require as much cooling flow. In future engines, especially IGT engines, the turbine inlet temperature will increase and result in the latter stage airfoils to be exposed to higher temperatures. To improve efficiency of the engine, low cooling flow airfoils are being studied that will use less cooling air while maintaining the metal temperature of the airfoils within acceptable limits. Also, as the TBC (thermal barrier coating) gets thicker, less cooling air is required to provide the same metal temperature as would be for a thicker TBC.

FIG. 1 shows an external pressure profile for a turbine rotor blade. As indicated in the figure, the forward region of the pressure side surface experiences high hot gas static pressure while the entire suction side of the airfoil is at a much lower hot gas static pressure than the pressure side. The pressure side pressure profile in the line on the top while the suction side pressure profile is the line on the bottom in the FIG. 1.

FIG. 2 shows a prior art turbine rotor blade with a (1+5+1) forward flowing serpentine cooling circuit for a first stage rotor blade. FIG. 3 shows a schematic view of the rotor blade of FIG. 2 and FIG. 4 shows a flow diagram of the flow path through the rotor blade, the prior art blade cooling circuit includes a leading edge cooling supply channel connected to a leading edge impingement cavity by a row of metering and impingement holes, and where the impingement cavity is connected to a showerhead arrangement of film cooling holes and gills holes on both sides to discharge a layer of film cooling air onto the leading edge surface of the airfoil. A forward flowing 5-pass serpentine cooling circuit is used in the airfoil mid-chord region with a first leg for supplying cooling air located adjacent to the trailing edge region of the airfoil. The second leg, third leg, fourth leg and fifth leg of the serpentine flow toward the leading edge in series with rows of film cooling holes connected to the 5 legs to discharge film cooling air onto one or both side of the airfoil. The cooling air flows from the trailing edge region toward the leading edge region and discharges into the hot gas side pressure section of the pressure side of the airfoil. In order to satisfy the back flow margin criteria, a high cooling supply pressure is needed for this particular design, and thus inducing a high leakage flow. In the prior art cooling arrangement of FIG. 2, the blade tip section is cooled with double tip turns in the serpentine circuit and with local film cooling. Cooling air bled off from the 5-pass serpentine flow circuit will thus reduce the cooling performance for the serpentine flow circuit. Independent cooling flow circuit is used to provide cooling circuits from the 5-pass serpentine flow circuit is used for cooling of the airfoil leading and trailing edges.

As the TBC technology improves and more industrial turbine blades are applied with thicker or low conductivity TBC, the amount of cooling flow required for the blade will be reduced. As a result, there is not sufficient cooling flow for the prior art design with the 1+5+1 forward flowing serpentine cooling circuits of FIG. 2. Cooling flow for the blade leading edge and trailing edge has to be combined with the mid-chord flow circuit to form a single 5-pass flow circuit. However, for a single forward flow 5-pass circuit with total blade cooling flow BFM (back flow margin) may become a design problem.

BRIEF SUMMARY OF THE INVENTION

It is an object of the present invention to provide for a turbine rotor blade with a thick TBC and low cooling flow for a low gas temperature condition.

The above objective and more are achieved with the cooling circuit for a rotor blade of the present invention which includes a maze flowing 5-pass serpentine flow circuit that includes an aft flowing 3-pass serpentine flow circuit in series with a forward flowing 2-pass serpentine flow circuit in which the 2-pass serpentine circuit provides cooling for the blade mid-chord region. The first leg of the aft flowing 3-pass serpentine circuit is connected to a row of showerhead film cooling holes to provide film cooling for the leading edge region of the blade. The last and third leg of the aft flowing 3-pass serpentine circuit is connected to a trailing edge cooling circuit that includes multiple impingement holes with a row of exit cooling holes to discharge the cooling air. The forward flowing 2-pass serpentine circuit discharges into a blade tip cooling channel to provide cooling for the tip region and to discharge cooling air though tip cooling holes.

DETAILED DESCRIPTION OF THE INVENTION

Figure 1:
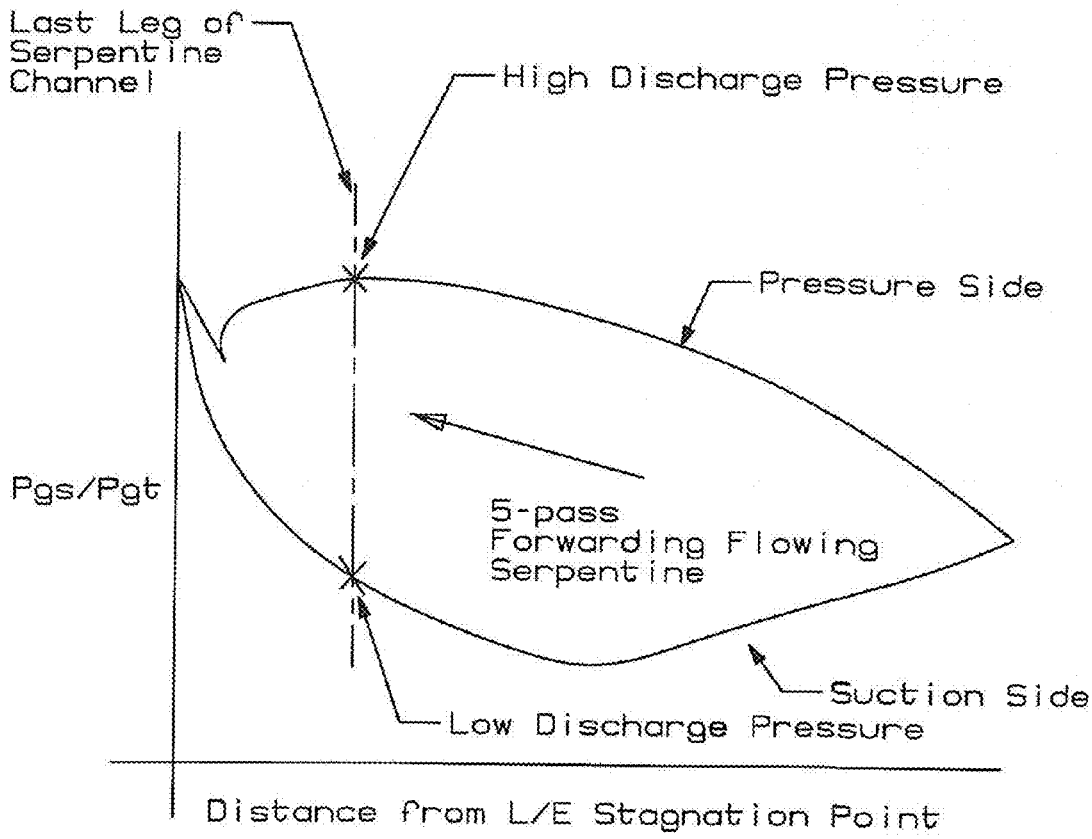
Fig 1 Prior Art
FIG. 1 shows a graph of a turbine rotor blade external pressure profile.
Figure 2:
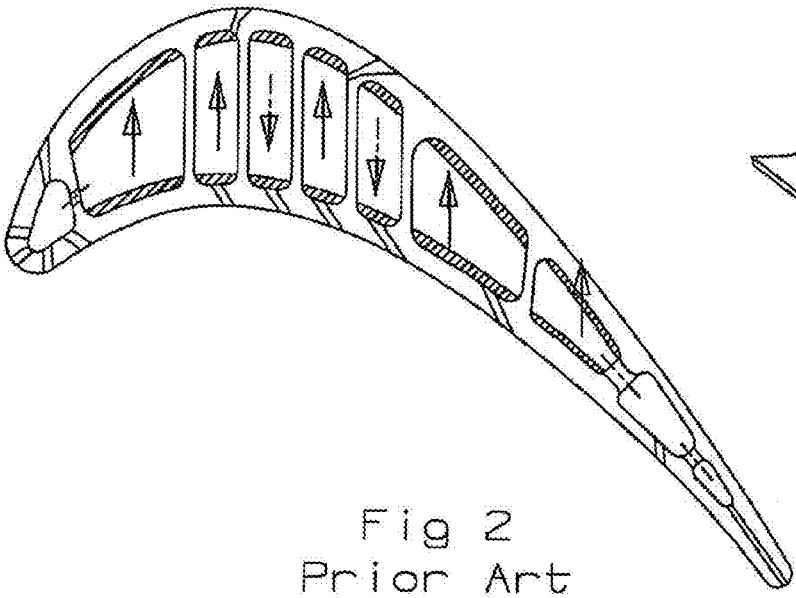
Fig 2 Prior Art
FIG. 2 shows a cross section top view of a prior art turbine rotor blade 1+5+1 forward flowing serpentine cooling circuit.
Figure 3:
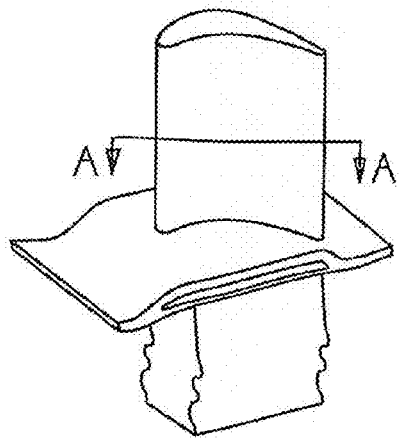
Fig 3 Prior Art
FIG. 3 shows a schematic view of the prior art turbine rotor blade.
Figure 4:
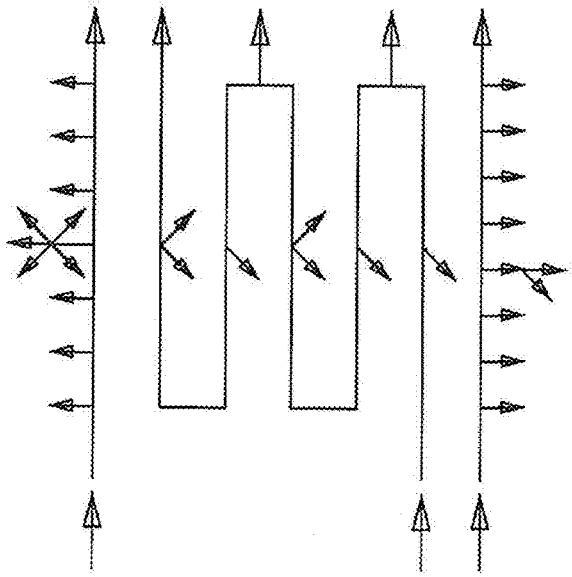
Fig 4 Prior Art
FIG. 4 shows a flow diagram of the prior art 1+5+1 serpentine flow cooling circuit of FIG. 2.
Figure 5:
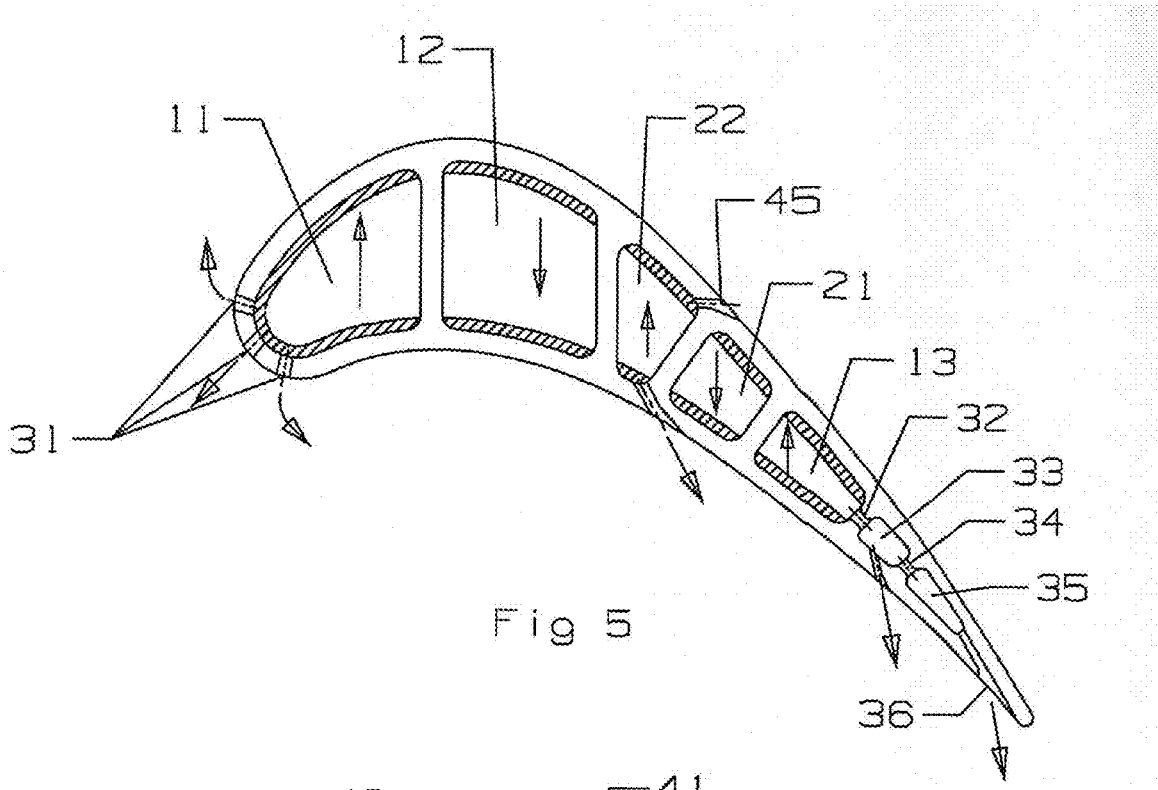
FIG. 5 shows a cross section top view of the cooling circuit of the present invention.
Figure 6:
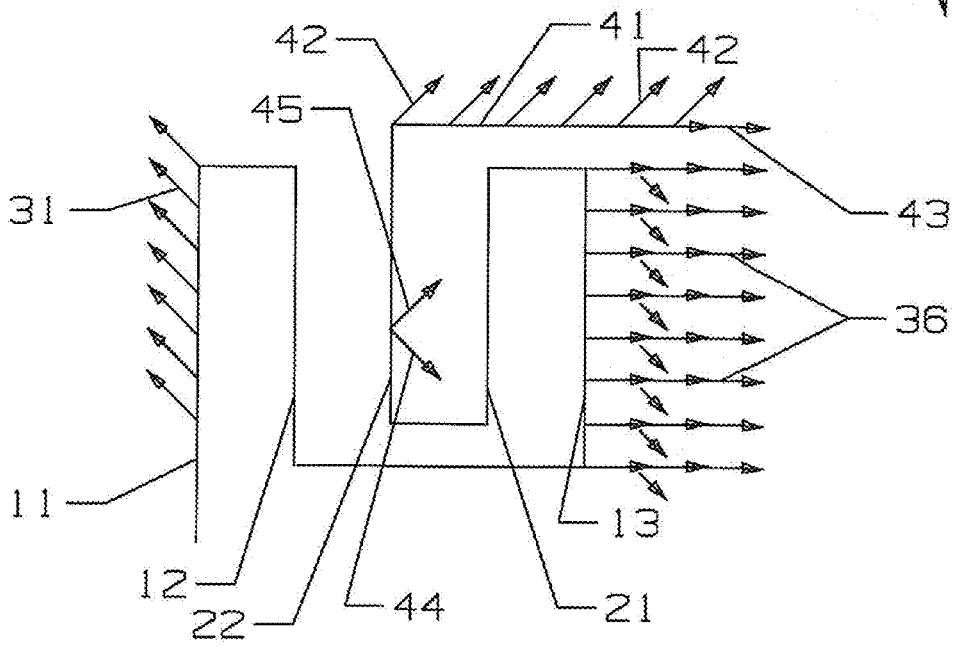
FIG. 6 shows a flow diagram of the cooling circuit of the present invention.
Figure 7:
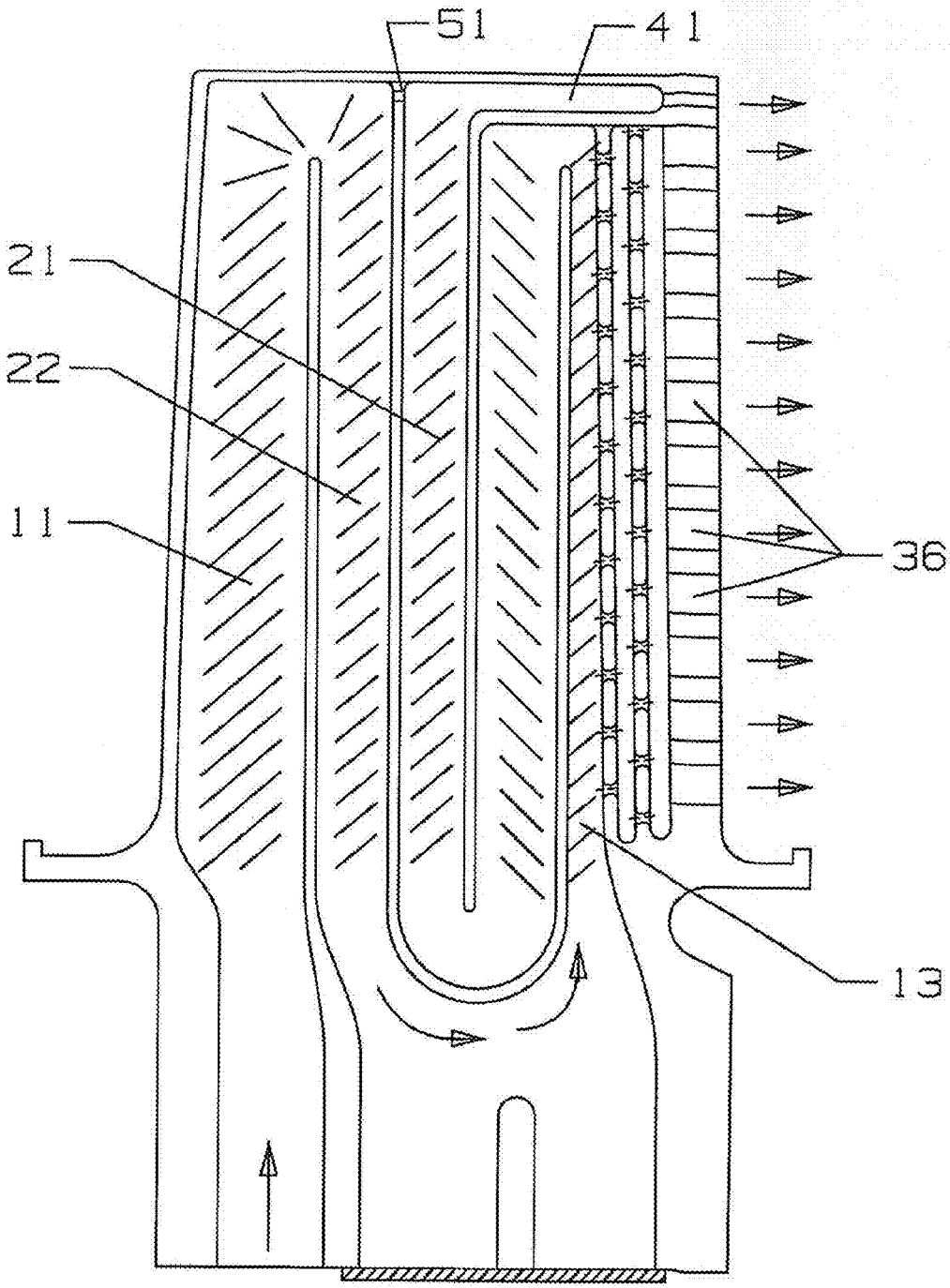
FIG. 7 shows a cross section side view of the turbine rotor blade cooling circuit of the present invention.

The serpentine flow cooling circuit for the rotor blade of the present invention is shown in FIGS. 5 through 7 with the aft flowing 3-pass serpentine circuit having three channels or legs 11-13 and the forward flowing 2-pass serpentine circuit having two channels or legs 21 and 22 formed between the pressure side wall and the suction side wall of the blade. The first leg 11 of the aft flowing 3-pass serpentine circuit is located along the leading edge of the blade and is connected to an arrangement of showerhead film cooling holes 31. The first leg 11 flows from the root to the blade tip and then into the second leg 12 which flows downward toward the root section of the blade. The second leg 12 is connected to the third leg 13 which is positioned adjacent to a trailing edge region of the blade.

The trailing edge region is cooled by a series of impingement holes that discharge into impingement cavities with the last impingement cavity connected to a row of exit cooling holes or slots formed on the pressure side wall of the trailing edge region to discharge the spent cooling air. In this particular embodiment, the trailing edge cooling circuit includes a row of first metering holes 32 that discharge into a first impingement channel 33, and then through a second row of metering holes 34 and into a second impingement channel 35, which is connected to the row of exit slots 36 to discharge the spent cooling air.

Positioned between the second leg 12 and the third leg 13 of the aft flowing 3-pass serpentine circuit is the forward flowing 2-pass serpentine circuit with the first leg 21 connected at the end of the third leg 13 of the 3-pass serpentine circuit, the second leg 22 is connected to the first leg 21 at a root turn as seen in FIG. 6. the second leg 22 flows up and into a blade tip cooling channel 41 located under the blade tip an aft of the tip turn of the first and second legs 11 and 12 of the 3-pass serpentine circuit, the tip cooling channel 41 is connected to tip cooling holes 42 that discharge most of the tip cooling air onto the external surface of the blade tip with the remaining tip channel cooling air being discharged through the tip cooling channel exit hole 43 located at the trailing edge. Two rows of film cooling holes 44 and 45 are connected to the second leg 22 of the 2-pass serpentine circuit on both the pressure side and the suction side walls to discharge film cooling air.

FIG. 7 shows a cross section side view of the cooling circuit for the blade. The first leg 11 of the 3-pass serpentine circuit is located adjacent to the leading edge and flows upward and into the tip turn that leads into the second leg 12. The tip turn will provide cooling for the section of the blade tip not covered by the tip cooling channel 41. The third leg 13 flows up and along the trailing edge region to supply cooling air to the metering holes and impingement channels formed in the trailing edge region. Any remaining cooling air from the third leg 13 will flow into the first leg 21 of the forward flowing 2-pass serpentine circuit and into the second leg 22, where some of the cooling air flows through the pressure side and suction side film cooling holes 44 and 45. the remaining cooling air in the second leg 22 will flow up and into the tip cooling channel 41 to provide cooling for the tip section and to discharge most of the tip channel cooling air through the tip cooling holes 42 with any remaining tip channel cooling air flowing out through the exit hole 43 connected to the tip cooling channel 41. As seen in FIG. 7, all of the legs or channels of both serpentine flow circuits includes trip strips along the walls to promote heat transfer from the hot metal surfaces to the cooling air flow.

A cross-over hole 51 can be used to connect the tip turn of the aft flowing 3-pass serpentine circuit to the tip cooling channel and the second leg of the forward flowing 2-pass serpentine flow circuit as seen in FIG. 7. The rotor blade with the cooling circuit described above can be formed using the investment casting process in which the cooling channels, metering holes and impingement channels and other features are formed by core ties using the lost wax process. Film cooling holes can be drilled after the blade has been cast.

The cooling circuit of the present invention delivers fresh cooling air to the leading edge region first. Since the cooling air temperature is fresh (meaning it hasn't been heated up yet from the hot metal temperatures) and the blade leading edge section experiences the highest heat load on the entire airfoil external surface, the use of the cooling air potential to achieve a low local metal temperature is maximized, which yields a higher oxidation life for the blade.

The aft flowing 3-pass serpentine circuit used for the airfoil forward section will maximize the use of cooling air pressure potential. Since the cooling air is discharged on the airfoil leading edge region where the main stream hot gas side pressure is relatively high, the aft flowing 3-pass serpentine circuit will consume less pressure than will the forward flowing 5-pass serpentine flow circuit of the prior art. This result in a low cooling supply pressure needed to produce the required airfoil cooling.

At an end of the aft flowing 3-pass serpentine circuit is the forward flowing 2-pass serpentine flow circuit that provides cooling for the mid-portion of the blade mid-chord section. The forward flowing 2-pass serpentine circuit used for the airfoil mid section surface will maximize the use of cooling to main stream gas side heat load potential. The heat load at the blade mid-chord section is lower than at the leading edge and the trailing edge of the airfoil. The spent cooling air is then channeled through the blade tip section axial flow channel to provide blade section cooling and is then discharged along the blade pressure side peripheral at the aft section of the airfoil to provide cooling of the blade tip edge. This design yields a lower cooling air supply pressure requirement and a lower leakage flow.

I claim the following:

1. An air cooled turbine rotor blade comprising:

an airfoil having an airfoil cross sectional shape with a leading edge and a trailing edge, and a pressure side wall and a suction side wall both extending between the two edges;

a showerhead arrangement of film cooling holes on the leading edge region to provide film cooling for the leading edge of the airfoil;

a trailing edge cooling circuit that includes a row of metering holes that discharge into an impingement channel, and a row of exit slots that discharge spent cooling air out the trailing edge region of the airfoil;

a first aft flowing serpentine flow circuit having a first leg located adjacent to the leading edge of the airfoil and connected to the showerhead arrangement of film cooling holes;

the first aft flowing serpentine flow circuit includes a last leg located adjacent to the trailing edge cooling circuit to supply cooling air to the trailing edge cooling circuit;

a second forward flowing serpentine flow circuit located between the first and last legs of the first aft flowing serpentine flow circuit; and, the first leg of the second forward flowing serpentine flow circuit being connected to the last leg of the first aft flowing serpentine flow circuit.

2. The air cooled rotor blade of claim 1, and further comprising:

the legs of the first and second serpentine flow circuits each extend from a platform region of the blade to the tip region of the blade.

3. The air cooled turbine rotor blade of claim 1, and further comprising:

the first aft flowing serpentine flow circuit includes a second leg upstream of the last leg with a tip turn located underneath the blade tip region that provides cooling for a forward section of the blade tip.

4. The air cooled turbine rotor blade of claim 3, and further comprising:

a blade tip cooling channel to provide cooling for the blade tip section not covered by the tip turn of the first serpentine flow circuit; and, the last leg of the second forward flowing serpentine circuit is connected to the tip cooling channel.

5. The air cooled turbine rotor blade of claim 1, and further comprising:

the last leg of the second forward flow serpentine circuit is connected to a row of film cooling holes on either the pressure side wall or the suction side wall to discharge film cooling air from the last leg.

6. The air cooled turbine rotor blade of claim 1, and further comprising:

the first aft flowing serpentine flow circuit is a 3-pass serpentine circuit; and, the second forward flowing serpentine flow circuit is a 2-pass serpentine circuit.

7. The air cooled turbine rotor blade of claim 6, and further comprising:

the second forward flowing serpentine flow circuit is positioned between the second leg and the last or third leg of the first aft flowing serpentine flow circuit.

8. The air cooled turbine rotor blade of claim 1, and further comprising:

a blade tip cooling channel connected to the second forward flowing serpentine circuit to provide cooling for a section of the blade tip.

9. The air cooled turbine rotor blade of claim 1, and further comprising:

the trailing edge region cooling circuit includes two rows of metering holes and two impingement channels located downstream from the metering holes, and a row of exit slots opening onto the pressure side wall of the airfoil.

10. The air cooled turbine rotor blade of claim 9, and further comprising:

the first impingement channel located immediately downstream from the first row of metering holes is connected to a row of film cooling holes that open onto the pressure side wall.

* * * * *